US009038745B2

(12) United States Patent
Mattson et al.

(10) Patent No.: US 9,038,745 B2
(45) Date of Patent: May 26, 2015

(54) HAND POWER TOOL AND DRIVE TRAIN

(75) Inventors: Christopher Mattson, Provo, UT (US); Robert Campbell, Provo, UT (US); Clark Davis, Genola, UT (US); David Olligschlager, Provo, UT (US); Brad Solomon, Springville, UT (US); Samuel Wilding, Springville, UT (US)

(73) Assignee: Brigham Young University, Provo, UT (US)

( * ) Notice: Subject to any disclaimer, the term of this patent is extended or adjusted under 35 U.S.C. 154(b) by 690 days.

(21) Appl. No.: 13/329,251

(22) Filed: Dec. 17, 2011

(65) Prior Publication Data

US 2012/0152580 A1 Jun. 21, 2012

Related U.S. Application Data

(60) Provisional application No. 61/459,871, filed on Dec. 20, 2010.

(51) Int. Cl.

| | |
|---|---|
| ***B25B 21/00*** | (2006.01) |
| ***B25B 21/02*** | (2006.01) |
| ***B25F 5/00*** | (2006.01) |

(52) U.S. Cl.

CPC ..... *B25B 21/00* (2013.01); *B25B 21/02* (2013.01); *B25F 5/001* (2013.01)

(58) Field of Classification Search

USPC ..... 173/39, 48, 213, 216, 217, 201; 81/57, 81/57.26, 57.28; 310/47, 50; 408/124, 127

See application file for complete search history.

(56) References Cited

U.S. PATENT DOCUMENTS

| | | | | | |
|---|---|---|---|---|---|
| 1,806,582 | A | * | 5/1931 | Beutner | 30/390 |
| 2,106,937 | A | * | 2/1938 | Torbert, Jr. | 408/127 |
| 2,273,626 | A | * | 2/1942 | Connell | 74/810.1 |
| 2,414,637 | A | * | 1/1947 | Crump | 173/213 |
| 4,346,767 | A | | 8/1982 | Vaughan | |
| 4,347,450 | A | * | 8/1982 | Colligan | 310/50 |
| 4,810,916 | A | * | 3/1989 | McBride | 310/50 |
| 5,149,230 | A | * | 9/1992 | Nett | 408/42 |
| 5,165,172 | A | * | 11/1992 | Weinrauch | 30/199 |
| 5,533,581 | A | * | 7/1996 | Barth et al. | 173/216 |
| 5,653,294 | A | | 8/1997 | Thurler | |
| 5,784,934 | A | | 7/1998 | Izumisawa | |
| 5,816,121 | A | * | 10/1998 | Yoshimizu et al. | 81/469 |
| 6,218,746 | B1 | * | 4/2001 | Gouge, Jr. | 310/50 |
| 6,230,717 | B1 | * | 5/2001 | Marx et al. | 132/308 |
| 6,296,427 | B1 | * | 10/2001 | Potter et al. | 408/124 |

(Continued)

OTHER PUBLICATIONS

Makita, Makita Industrial Power Tools General Catalog, 2010.

*Primary Examiner* — Scott A. Smith

(57) ABSTRACT

A drive train for supplying power to a power tool may include, a motor, a motor shaft, a rotational coupling mechanism connected to the motor shaft, and a drive shaft connected to the rotational coupling mechanism that forms the shape of a "U." A pair of enmeshed bevel gears transfers the motion from the motor shaft to an orthogonal tool bit. The drive train may also include a hammering device that transfers a rotational impacting motion to the tool bit. A hand power tool for driving a screw may include a tool shell with an integrally formed vertical handle, a rotational recess formed into the tool shell opposite the handle, and a tool chuck within the rotational recess that drives a screw. The tool may incorporate the drive train as described above. The tool may include a mechanism for locking the tool chuck in a particular position.

19 Claims, 5 Drawing Sheets

(56) References Cited

U.S. PATENT DOCUMENTS

| | | | | |
|---|---|---|---|---|
| 6,461,088 | B2 * | 10/2002 | Potter et al. | 408/124 |
| 6,843,330 | B2 * | 1/2005 | Schmid et al. | 173/217 |
| 7,204,026 | B2 * | 4/2007 | Phillips et al. | 30/394 |
| 7,207,233 | B2 * | 4/2007 | Wadge | 74/412 R |
| 7,331,408 | B2 * | 2/2008 | Arich et al. | 173/201 |
| 7,540,335 | B2 * | 6/2009 | Andriolo et al. | 173/18 |
| 7,654,339 | B2 | 2/2010 | Fuchs | |
| 7,779,931 | B2 * | 8/2010 | Townsan | 173/216 |
| 7,926,585 | B2 | 4/2011 | Pozgay et al. | |
| 8,261,850 | B2 * | 9/2012 | Fuchs | 173/117 |
| 2003/0200841 | A1 | 10/2003 | Novotny | |
| 2005/0279519 | A1 | 12/2005 | Clark | |
| 2008/0087449 | A1 | 4/2008 | Lam | |

* cited by examiner

HAND POWER TOOL AND DRIVE TRAIN

RELATED APPLICATIONS

This application claims priority to U.S. Provisional Patent Application No. 61/459,871 entitled "Combination Impact Driver and Ninety Degree Driver" and filed on 20 Dec. 2010 for Christopher Mattson, Robert Campbell, Clark Davis, David Olligschlager, Brad Solomon, and Samuel Wilding. The aforementioned application is incorporated herein by reference in its entirety.

BACKGROUND OF THE INVENTION

1. Field of the Invention

This invention relates generally to hand power tools and more particularly relates to a drive train for supplying power to a powered hand tool.

2. Description of the Related Art

Impact drivers are rotary tools that incorporate a rotational impacting motion to drive a screw into a medium. Ninety degree drivers have swiveling heads that allow a user to drive a screw into a medium in tight spaces. Often times a project requires the use of both drivers. Providing a drive train that powers both an impact driver and a ninety degree driver, would therefore provide advantages that are lacking in currently available drivers.

SUMMARY OF THE INVENTION

The present invention has been developed in response to the present state of the art, and in particular, in response to the problems and needs in the art that have not yet been fully solved by currently available drive trains. Accordingly, the present invention has been developed to provide a drive train that supplies power to a combined impact driver and ninety degree driver that overcomes many of the shortcomings in the art.

As described below, a drive train for supplying power to a power tool may include, a motor that supplies electrical power, a motor shaft connected to the motor, a rotational coupling mechanism that is connected perpendicular to the motor shaft, and a drive shaft that is connected perpendicular to the rotational coupling mechanism. In one embodiment, the drive train forms the shape of a "U." A pair of enmeshed bevel gears may transfer the motion from the motor shaft to an orthogonal tool bit. The drive train may also include a hammering device that transfers a rotational impacting motion to the tool bit.

Additionally, as described below, a hand power tool for driving a screw into a medium may include, a tool shell having an aperture with an integrally formed vertical handle, a rotational recess formed into a portion of the tool shell opposite the handle, and a rotating tool chuck located within the rotational recess that drives a screw into a medium. In one example, the power tool may incorporate the drive train as described herein. The hand power tool may also include a mechanism for selectively rotating the tool chuck and locking it in a particular position.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
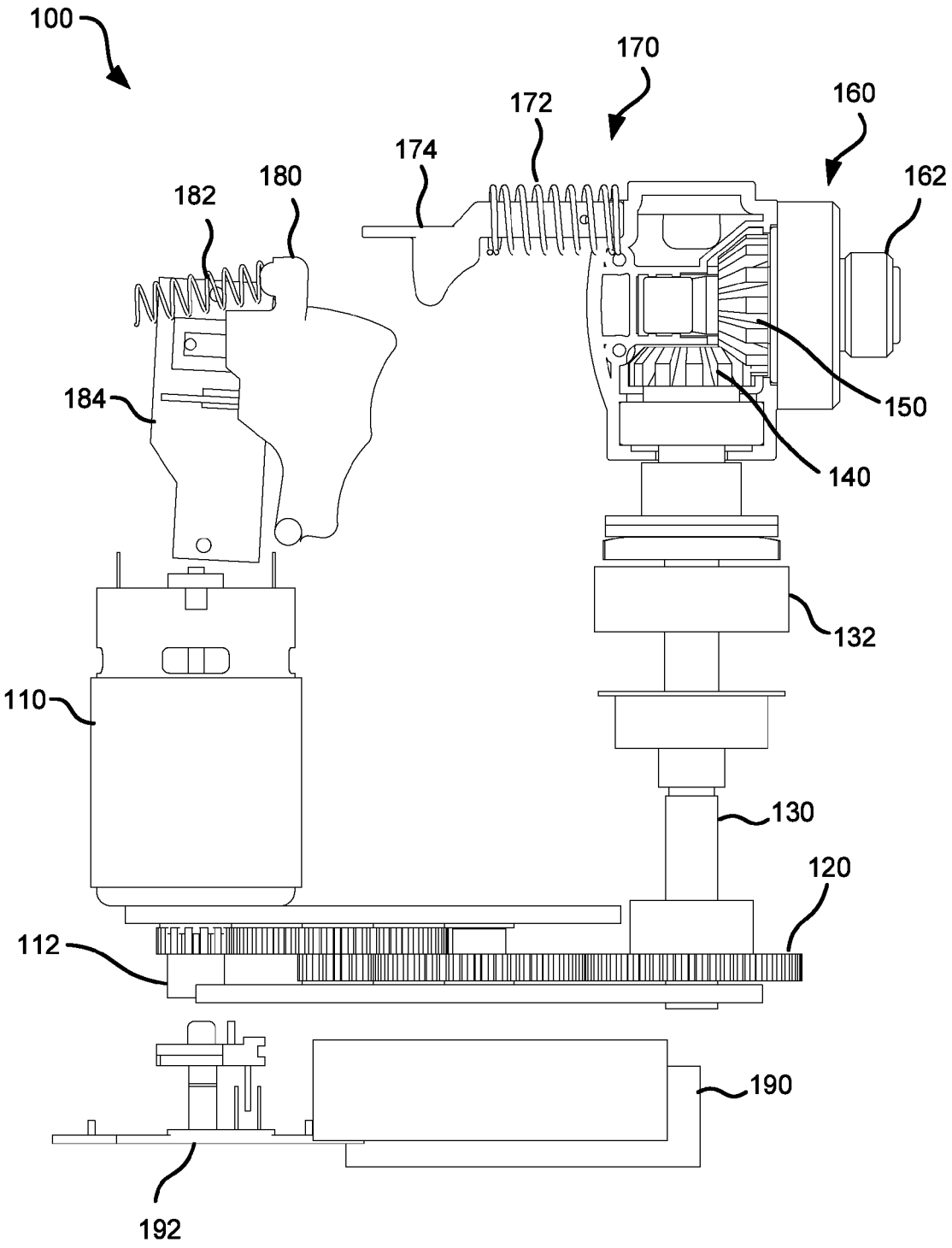
FIG. 1 is detailed side view illustration of one embodiment of a drive train of the present invention suitable for a powered hand tool.

FIG. 1 is detailed side view illustration of one embodiment of a drive train for a powered hand tool 100 of the present invention. As depicted, the drive train 100 includes a motor 110 with an attached motor shaft 112, a rotational coupling mechanism 120, a drive shaft 130, a pair of bevel gears 140, 150, a tool chuck assembly 160 with a tool chuck 162, a locking mechanism 170, a speed controller 180, and a battery 190.

The drive train 100 may include a motor 110 which converts electrical power into rotational motion. In certain embodiments the motor 110 may be a reversible motor capable of providing rotational motion in either a clockwise or a counter clockwise direction. The electrical power may be supplied to the motor 110 by a battery 190 electrically coupled to the motor through the battery board 192. The motor 110 may be attached to a rotational coupling mechanism 120 through a motor shaft 112. According to one embodiment, the rotational coupling mechanism 120 is positioned perpendicular to the motor 110. Examples of rotational coupling mechanisms 120 include, but are not limited to, a gear set, a belt, a chain, and a sun gear. A drive shaft 130 may be mechanically coupled to the rotational coupling mechanism 120 opposite the motor shaft 112. According to one example, the drive shaft 130 may be positioned perpendicular to the rotational coupling mechanism 120. In this example, the drive shaft 130 is parallel to the motor shaft.

The drive train also may include a first bevel gear 140 coupled to the drive shaft 130. A second bevel gear 150, orthogonally enmeshed with the first bevel gear 140, may convert the rotational motion from a generally vertical axis to a generally horizontal axis. In one embodiment, the drive train 100 may also include a hammering device 132. The hammering device 132 converts a portion of the rotational motion supplied by the motor 110 into a rotational impacting motion. This rotational impacting motion is similarly converted from a generally vertical axis to a generally horizontal axis through the bevel gears 140, 150, which are housed in the tool chuck assembly 160. The tool chuck assembly 160 may house a tool chuck 162 that is mechanically coupled to the second bevel gear 150. The tool chuck 162 may be configured to receive a tool bit.

According to one embodiment the tool chuck assembly 160 is configured to rotate about a generally vertical axis. For example, the second bevel gear 150 and the tool chuck 162 may rotate along with the tool chuck assembly 160 and the second bevel gear 150 may be continually enmeshed with the first bevel gear 140 such that tool chuck 162 is rotationally coupled to the drive shaft 130 at all times.

In one embodiment where the tool chuck assembly 160 is configured to rotate, the drive train may include a locking mechanism 170 that maintains the tool chuck assembly 160 in a selected position. The locking mechanism 170 may include a spring-loaded shaft 172 that locks the tool chuck assembly 160 in a selected position. A trigger 174 coupled to the spring-loaded shaft 172 may allow a user to disengage the spring-loaded shaft 172 from the tool chuck assembly 160 such that it may be freely rotated.

The drive train 100 may include a speed controller 180 which allows a user to activate the motor 110. In one example, the speed controller 180 may include a speed board 184 that completes an electric circuit between the battery 190 and the motor 110 when the spring 182 is compressed. When the spring 182 is not compressed, no power is supplied. Moreover, the drive train 100 may include a battery 190 that supplies electric power to the motor 110 through the battery board 192. While in the depicted view the battery 190 is located below the rotational coupling mechanism 120, the battery 190 may be located at any position along the drive train 100.

Figure 2:
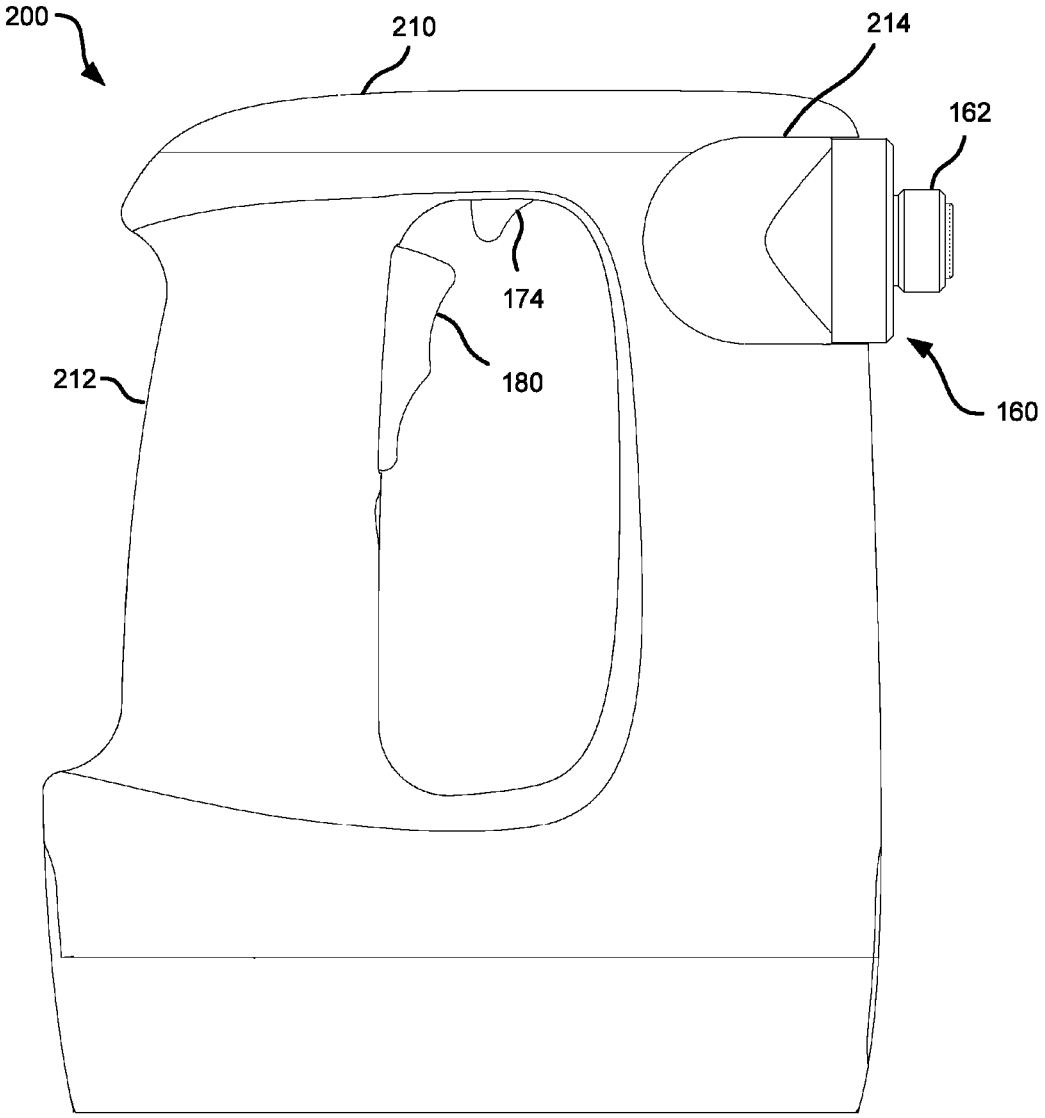
FIG. 2 is a detailed side view illustration of one embodiment of a powered hand tool of the present invention.

FIG. 2 is a detailed side view illustrations of one embodiment of a powered hand tool 200 of the present invention. As depicted the hand tool 200 may include, a tool shell 210 with an integrally formed handle 212, a rotational recess 214 disposed within the tool shell 210 opposite the handle 212, the tool chuck assembly 160 with the tool chuck 162, the speed controller, and the trigger 174.

In one embodiment the hand tool 200 includes a tool shell 210 that has an aperture at its center. The handle 212 may be integrally formed into one side of the tool shell 210. The speed controller 180 may be positioned within the aperture, on the same side of the tool shell 210 as the handle 212, which would allow a user to change the speed of the motor (not shown) while gripping the handle 212. The trigger 174 may also be placed within the aperture such that it could be easily engaged and allow the tool chuck assembly 160 to freely rotate.

The power tool 200 may also include a rotational recess 214 integrally formed into the tool shell 210. According to one embodiment, the rotational recess 214 is positioned on a side of the tool shell 210 opposite the handle 212. In this example, a user may exert force on the handle 212, which transfers through the tool shell 210 directly to the tool chuck assembly 160 and tool chuck 162 which are housed in the rotational recess 214. This improves the driving force of the power tool 200. In this example, the rotational recess 214 may be disposed near a top portion of the tool shell 210.

Figure 2A:
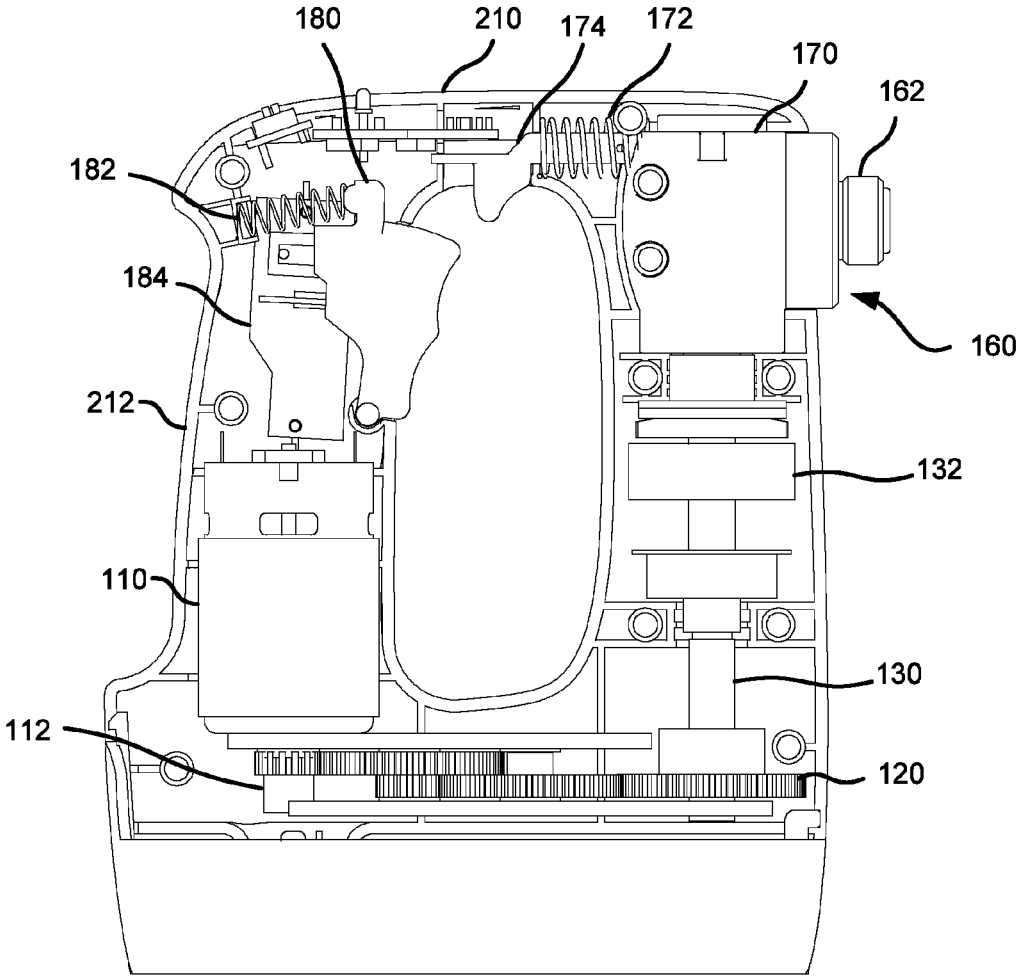
FIG. 2*a* is a detailed sectional side view illustration of one embodiment of a powered hand tool of the present invention.

FIG. 2*a* is a detailed sectional side view illustration of one embodiment of a powered hand tool 200 of the present invention. As depicted, the hand tool 200 includes the motor 110 and motor shaft 112, rotational coupling mechanism 120, drive shaft 130, hammering device 132, tool chuck assembly 160 with the tool chuck 162, locking mechanism 170, and speed controller 180 as described in FIG. 1, disposed within the tool shell 210. In this embodiment, the battery (not shown) is disposed within the tool shell 210.

According to one embodiment the motor 110 and motor shaft 112 are disposed within the tool shell 210 on the same side as the handle 212. The drive shaft 130 and bevel gears 140, 150 may be positioned within the tool shell 210 on a side opposite the motor 110 and motor shaft 112.

According to another embodiment, the battery 190 is disposed within the tool shell on the same side as the handle 214. In this embodiment the motor 110, motor shaft, 112, drive shaft 130 and bevel gears 140, 150 are positioned within the tool shell 210 on a side opposite the battery 190.

Figure 3:
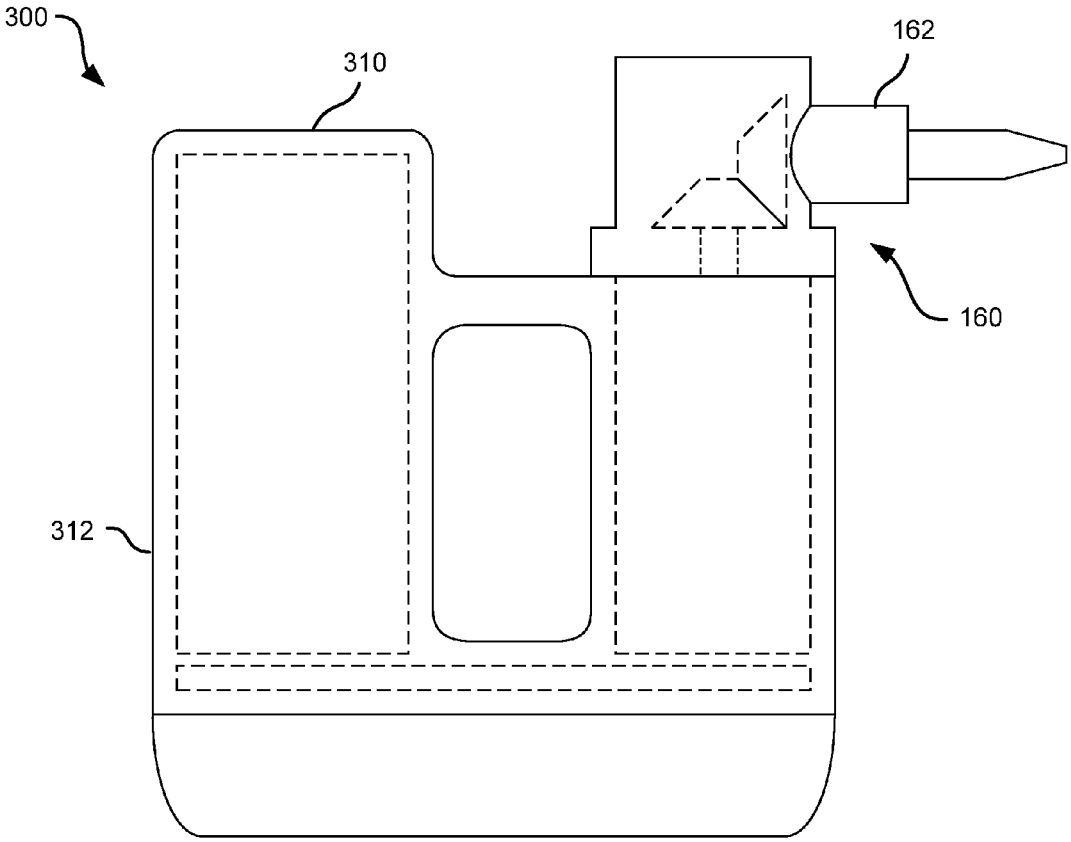
FIG. 3 is a side view illustration of one embodiment of a powered hand tool of the present invention.

FIG. 3 is a side view illustration of one embodiment of a powered hand tool 300 of the present invention. As depicted the hand tool 300 may include a tool shell 310 with an integrally formed handle 312, and the tool chuck assembly 160 with the tool chuck. In one embodiment the hand tool 300 includes a tool shell 310 that has an aperture at its center. A handle 312 may be integrally formed into one side of the tool shell 310. The speed controller (not shown) may be positioned within the aperture on the same side of the tool shell 310 as the handle, which would allow a user to easily change the speed of the motor (not shown) while gripping the handle 312. The trigger (not shown) may also be placed within the aperture such that it could be engaged and allow the tool chuck assembly 160 to freely rotate.

Figure 4:
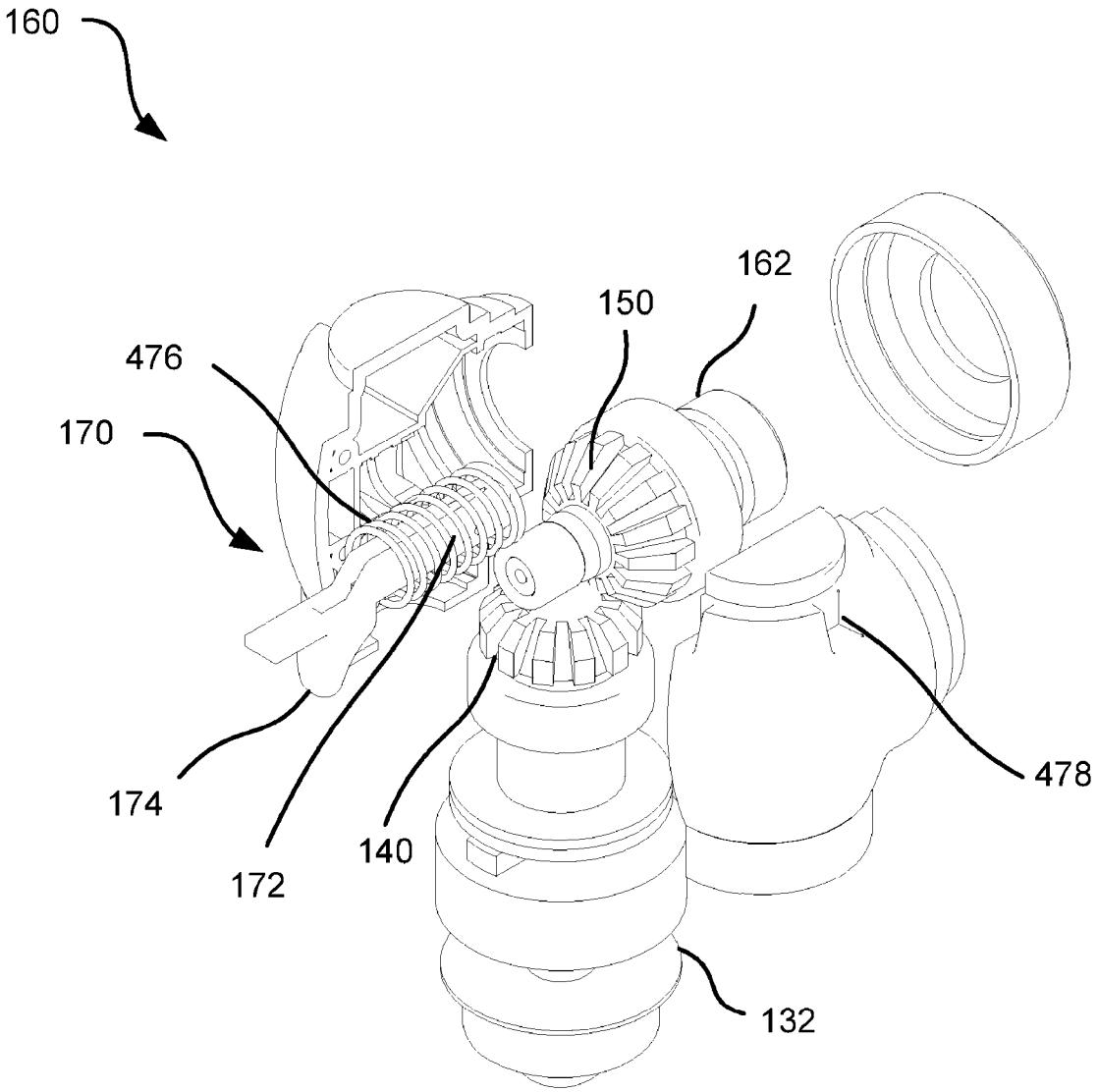
FIG. 4 is an exploded perspective view illustration of one embodiment of a tool chuck assembly of the present invention.

The power tool 300 may also include the tool chuck assembly 160 with the tool chuck 162 positioned vertical to the tool shell 310 on a side opposite the handle 312. Similar to the power tool in FIG. 2, aligning the chuck assembly 160 and handle 312 in this fashion allows the power tool 300 greater driving force FIG. 4 is an exploded perspective view illustration of one embodiment of a tool chuck assembly 160 of the present invention. As depicted, the tool chuck assembly 160 may include the drive shaft 130, the first bevel gear 140, the second bevel gear 150, and the tool chuck 162. The tool chuck assembly 160 may also include a locking mechanism 170 that allows a user to disengage the tool chuck assembly 160 such that it may freely rotate. In this example, the locking mechanism 170 may include a spring-loaded shaft 172 that interacts with a number of indentations 478 that are positioned along the outside surface of the tool chuck assembly 160. As the trigger 174 is activated, a spring 476 may be compressed which disengages the spring-loaded shaft 172 from the indentations 478. In this configuration, the tool chuck assembly 160 may freely rotate about a generally vertical axis.

The present invention provides an improved hand power tool and drive train. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drive train for a powered hand tool, the drive train comprising:

a motor that converts electrical power into rotational motion of a motor shaft about a first axis;

a drive shaft configured to rotate about a second axis, the second axis being substantially parallel to the first axis;

a rotational coupling mechanism configured to rotationally couple the motor shaft to the drive shaft;

a tool chuck configured to receive a tool bit;

a first bevel gear coupled to the drive shaft and configured to rotate about the second axis; and a second bevel gear orthogonal to, and enmeshed with, the first bevel gear such that the second bevel gear is configured to rotate about a third axis that is orthogonal to the second axis in response to rotation of the first bevel gear about the second axis, wherein the second bevel gear is coupled to the tool chuck such that, in a first mode the tool chuck is rotatable about the second axis, so as to adjust an orientation of the tool chuck, and in a second mode the tool chuck is rotatable about the third axis in response to operation of the motor and rotation of the second bevel gear about the third axis.

2. The drive train of claim 1, wherein the rotational coupling mechanism is substantially perpendicular to the motor shaft and the drive shaft.

3. The drive train of claim 2, wherein the motor shaft, the rotational coupling mechanism and the drive shaft define a 'U' shaped section of the drive train.

4. The drive train of claim 1, wherein the rotational coupling mechanism comprises a rotational coupler including one of a gear set, a belt, a chain, or a sun gear.

5. The drive train of claim 1, wherein the motor is a bidirectional motor configured to selectively rotate the motor shaft in first direction and a second direction about the first axis, the second direction being opposite the first direction.

6. The drive train of claim 1, further comprising a speed controller for controlling a speed of the motor.

7. The drive train of claim 1, further comprising a hammering device, having a first end thereof coupled to a distal end of the drive shaft and a second end thereof coupled to the first bevel gear, wherein the hammering device converts a rotational force supplied by the motor into a repeated rotational impact at the tool chuck.

8. The drive train of claim 1, further comprising a power supply that supplies electrical power to the motor.

9. The drive train of claim 8, wherein the power supply comprises a battery electrically connected to the motor.

10. The drive train of claim 7, wherein the repeated rotational impact at the tool chuck generated by the hammering device is exerted about the third axis.

11. The drive train of claim 1, wherein, in the second mode the motor generates a rotational force transmitted to the tool chuck via the motor shaft, drive shaft, and first and second bevel gears, for rotation of the tool chuck about the third axis, and in the first mode, the motor is in an off state or a standby state in which a rotational force is not transmitted from the motor to the tool chuck.

12. The drive train of claim 11, wherein, in the second mode the tool chuck is not rotatable about the second axis.

13. The drive train of claim 11, further comprising a locking mechanism selectively coupled to the tool chuck, wherein in the first mode, the tool chuck is rotatable about the second axis to a plurality of angular positions, the tool chuck being lockable in a selected angular position of the plurality of angular positions by the locking mechanism.

14. The drive train of claim 13, wherein in the second mode, the tool chuck is locked in the selected angular position of the plurality of angular positions by the locking mechanism for rotation about the third axis in response to operation of the motor.

15. A drive train for a powered hand tool, the drive train comprising:

a motor;

a motor shaft coupled to the motor and rotating about a first axis of rotation in response to a rotational force received from the motor;

a drive shaft rotating about a second axis of rotation offset from the first axis of rotation and arranged in parallel to the first axis of rotation;

a rotational coupling device coupling the motor shaft to the drive shaft;

a hammering device having a first end thereof coupled to the drive shaft;

a bevel gear assembly coupled to a second end of the hammering device, the bevel gear assembly converting the rotational force about the second axis of rotation from the drive shaft to a rotational force about a third axis of rotation that is orthogonal to the second axis of rotation; and a tool chuck coupled to the bevel gear assembly, wherein in a first mode, the tool chuck is configured to rotate about the second axis of rotation so as to selectively adjust an orientation of the tool chuck with the motor in an off state, and in a second mode, the hammering device is configured to convert the rotational force generated by the motor into a repeated rotational impact at the tool chuck that is exerted about the third axis of rotation as the tool chuck rotates about the third axis of rotation in response to the rotational force generated by the motor.

16. The drive train of claim 15, wherein, in the first mode, the motor is in an off state or a standby state, and the tool chuck is rotatable about the second axis of rotation to a plurality of angular positions.

17. The drive train of claim 16, further comprising a locking mechanism coupled to the tool chuck so as to fix the tool chuck in a selected angular position of the plurality of angular positions.

18. The drive train of claim 15, wherein the bevel gear assembly comprises:

a first bevel gear coupled to the second end of the hammering device, the first bevel gear rotating about the second axis of rotation; and a second bevel gear orthogonal to and enmeshed with the first bevel gear, the second bevel gear being coupled to the tool chuck and rotating about the third axis of rotation.

19. The drive train of claim 15, wherein the motor shaft, the rotational coupling mechanism and the drive shaft define a 'U' shaped section of the drive train.

* * * * *

UNITED STATES PATENT AND TRADEMARK OFFICE

CERTIFICATE OF CORRECTION

PATENT NO. : 9,038,745 B2
APPLICATION NO. : 13/329251
DATED : May 26, 2015
INVENTOR(S) : Christopher Mattson et al.

It is certified that error appears in the above-identified patent and that said Letters Patent is hereby corrected as shown below:

In The Claims

In column 5, line 53, in claim 7, delete "device," and insert -- device --, therefor.

Signed and Sealed this
Fifth Day of January, 2016

Michelle K. Lee

Michelle K. Lee
*Director of the United States Patent and Trademark Office*